US011359379B2

(12) United States Patent
Lenney

(10) Patent No.: US 11,359,379 B2
(45) Date of Patent: Jun. 14, 2022

(54) GUTTER GUARD BARRIER

(71) Applicant: GutterGlove, Inc., Roseville, CA (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

(21) Appl. No.: 16/666,353

(22) Filed: Oct. 28, 2019

(65) Prior Publication Data

US 2020/0157820 A1 May 21, 2020

Related U.S. Application Data

(60) Continuation of application No. 15/665,944, filed on Aug. 1, 2017, now Pat. No. 10,458,121, which is a division of application No. 14/641,604, filed on Mar. 9, 2015, now Pat. No. 9,765,524, which is a continuation of application No. 13/709,671, filed on Dec. 10, 2012, now abandoned.

(60) Provisional application No. 61/568,539, filed on Dec. 8, 2011.

(51) Int. Cl.

| | |
|---|---|
| ***E04D 13/076*** | (2006.01) |
| ***E04D 13/04*** | (2006.01) |
| ***E04B 1/41*** | (2006.01) |
| ***E04D 13/064*** | (2006.01) |

(52) U.S. Cl.

CPC ..... *E04D 13/0767* (2013.01); *E04B 1/40* (2013.01); *E04D 13/0404* (2013.01); *E04D 13/064* (2013.01); *E04D 13/076* (2013.01)

(58) Field of Classification Search

CPC . E04D 13/0767; E04D 13/064; E04D 13/076; E04D 13/0404; E04B 1/40

USPC ..... 52/12

See application file for complete search history.

(56) References Cited

U.S. PATENT DOCUMENTS

| | | | | |
|---|---|---|---|---|
| 1,732,058 | A | 10/1929 | Martini | |
| 2,229,381 | A | 1/1941 | Grow | |
| 2,288,121 | A | 6/1942 | Sandmeyer | |
| 2,569,568 | A | 10/1951 | Lipshaw | |
| 2,583,422 | A | 1/1952 | Haddon | |
| 21,674,961 | | 4/1954 | Lake | |
| 2,935,954 | A | 5/1960 | Matthews | |
| 2,997,763 | A | 8/1961 | Serfass | |
| 3,350,045 | A | 10/1967 | Mayers | |
| 3,630,383 | A * | 12/1971 | Reeves | B01D 29/01 210/404 |
| 3,691,343 | A | 9/1972 | Norman | |
| 3,925,264 | A | 12/1975 | Corte | |

(Continued)

FOREIGN PATENT DOCUMENTS

| | | | |
|---|---|---|---|
| AU | 2009200601 A1 * | 9/2009 | E04D 13/076 |
| JP | 06-146506 | 5/1994 | |

(Continued)

*Primary Examiner* — James M Ference

(74) *Attorney, Agent, or Firm* — Jonathan Kidney; Glen Gross; Intelink Law Group P.C.

(57) ABSTRACT

A gutter debris preclusion device for use with a gutter having a support structure being substantially rigid; a screen having a plurality of apertures and being disposed on the support structure; and, a fastener member disposed on the support structure and having a barrier member and a protective film removably attached to the barrier member.

5 Claims, 5 Drawing Sheets

(56) References Cited

U.S. PATENT DOCUMENTS 4,254,595 A * 3/1981 Crosslen ..... E04D 13/076 248/48.1
4,308,696 A 1/1982 Schroeder
4,435,466 A 3/1984 Kuhnel et al.
4,445,301 A * 5/1984 Tanski ..... E04D 13/076 52/11
4,553,356 A * 11/1985 Pepper ..... E04D 13/076 52/11
4,573,290 A 3/1986 Fleming
4,646,488 A 3/1987 Burns
4,745,710 A * 5/1988 Davis ..... E04D 13/076 210/473
4,750,300 A 6/1988 Winger
4,755,229 A 7/1988 Armanini
4,769,526 A 9/1988 Taouil
4,769,957 A * 9/1988 Knowles ..... E04D 13/076 210/247
4,827,686 A 5/1989 Stamper
4,941,299 A 7/1990 Sweers
4,949,514 A 8/1990 Weller
4,959,932 A 10/1990 Pfeifer
4,965,969 A * 10/1990 Antenen ..... E04D 13/076 248/48.1
5,010,696 A * 4/1991 Knittel ..... E04D 13/076 210/474
5,044,581 A 9/1991 Dressler
5,092,086 A * 3/1992 Rognsvoog, Sr. .... E04D 13/076 248/48.1
5,107,635 A 4/1992 Carpenter
5,109,640 A 5/1992 Creson
5,127,200 A 7/1992 Doran
5,181,350 A * 1/1993 Meckstroth ..... E04D 13/076 210/474
5,257,482 A 11/1993 Sichel
5,261,195 A 11/1993 Buckenmaier
5,315,090 A 5/1994 Lowenthal
5,391,858 A 2/1995 Tourangeau
5,398,464 A 3/1995 Jacobs
5,406,754 A * 4/1995 Cosby ..... E04D 13/076 52/12
5,438,803 A 8/1995 Blizard, Jr.
5,459,965 A * 10/1995 Meckstroth ..... E04D 13/076 210/474
5,555,680 A * 9/1996 Sweers ..... E04D 13/076 210/474
5,558,705 A 9/1996 Keemer et al.
5,611,175 A * 3/1997 Sweers ..... E04D 13/076 24/336
5,617,678 A 4/1997 Morandin
5,640,809 A * 6/1997 Iannelli ..... E04D 13/076 210/474
5,729,931 A * 3/1998 Wade ..... E04D 13/076 52/12
5,759,255 A 6/1998 Venturini et al.
5,836,117 A 11/1998 Johnson
5,842,311 A * 12/1998 Morin ..... E04D 13/076 52/12
5,842,469 A 12/1998 Rapp et al.
5,848,857 A * 12/1998 Killworth ..... E04D 13/076 405/118
5,878,533 A 3/1999 Swanfeld
5,893,240 A 4/1999 Ealer, Sr.
6,016,631 A * 1/2000 Lowrie, III ..... E04D 13/076 52/12
6,098,345 A * 8/2000 Demartini ..... E04D 13/076 210/474
6,102,794 A * 8/2000 Cline ..... F24F 7/02 454/368
6,134,843 A 10/2000 Tregear
6,151,836 A * 11/2000 McGlothlin ..... E04D 13/064 248/48.1
6,161,338 A * 12/2000 Kuhns ..... E04D 13/076 210/474
6,194,049 B1 2/2001 Bindschedler-Galli et al.
6,194,519 B1 2/2001 Blalock et al.
6,205,715 B1 3/2001 Rex
6,225,600 B1 5/2001 Burris
6,269,592 B1 * 8/2001 Rutter ..... E04D 13/076 248/48.1
6,314,685 B1 * 11/2001 Sullivan ..... E04D 13/064 52/11
6,341,462 B2 1/2002 Kiilk et al.
6,393,770 B1 * 5/2002 Groom ..... E04D 13/076 52/12
6,412,228 B1 * 7/2002 Meckstroth ..... E04D 13/076 210/474
6,463,700 B2 * 10/2002 Davis ..... E04D 13/076 210/474
6,468,613 B1 10/2002 Kitano
6,598,352 B2 7/2003 Higginbotham
6,607,781 B2 8/2003 Joedicke et al.
6,672,012 B2 * 1/2004 Bahroos ..... E04D 13/076 210/162
6,700,098 B1 3/2004 Wyatt et al.
6,701,674 B1 * 3/2004 Albracht ..... E04D 13/0725 52/11
6,708,452 B1 3/2004 Tenute
6,756,930 B1 6/2004 Nunuparov et al.
6,883,760 B2 * 4/2005 Seise, Jr. ..... E04D 13/076 210/474
6,904,718 B2 * 6/2005 Fox ..... E04D 13/076 52/11
6,933,007 B2 8/2005 Fensel et al.
6,942,419 B2 9/2005 Knak
6,944,991 B2 9/2005 Kim
6,944,992 B2 9/2005 Brochu
6,951,077 B1 * 10/2005 Higginbotham ..... E04D 13/076 210/499
6,959,512 B2 11/2005 Cobb
7,056,422 B2 6/2006 Swistun
7,104,012 B1 9/2006 Bayram
7,174,688 B2 2/2007 Higginbotham
7,191,564 B2 * 3/2007 Higginbotham ..... E04D 13/076 210/474
7,241,500 B2 7/2007 Shiao et al.
7,310,912 B2 * 12/2007 Lenney ..... E04D 13/076 210/162
7,448,167 B2 11/2008 Bachman
7,624,541 B2 12/2009 Gentry
7,650,720 B2 * 1/2010 Ealer, Sr. ..... E04D 13/076 52/12
7,665,247 B1 * 2/2010 Pratt ..... E04D 13/076 52/12
7,726,076 B2 6/2010 Staub
7,765,742 B2 * 8/2010 Ealer, Sr. ..... E04D 13/076 52/12
7,793,465 B2 9/2010 McCann
7,913,458 B2 3/2011 Higginbotham
D638,920 S 5/2011 Ealer, Sr.
7,975,435 B2 7/2011 Lenney
8,006,438 B2 8/2011 Higginbotham
8,033,058 B2 10/2011 Dussault et al.
8,079,183 B2 12/2011 Lenney
8,397,436 B2 * 3/2013 Higginbotham ..... E03F 1/00 52/12
8,402,697 B1 * 3/2013 Ealer, Sr. ..... E04D 13/076 52/12
8,418,410 B2 4/2013 Martin
8,495,837 B2 7/2013 McCoy
8,572,899 B1 * 11/2013 Pearce ..... E04D 13/0767 52/12
8,677,694 B2 * 3/2014 Ash ..... E04D 13/076 52/12
2001/0054625 A1 12/2001 Iggulden
2003/0046876 A1 3/2003 Higginbotham
2003/0198736 A1 10/2003 Fensel et al.
2005/0072114 A1 4/2005 Shiao et al.
2005/0081981 A1 * 4/2005 Heikkila ..... E06B 3/5454 156/109

(56) References Cited

U.S. PATENT DOCUMENTS

2005/0155919 A1* 7/2005 Swistun ..... E04D 13/076 210/155
2005/0155920 A1* 7/2005 Swistun ..... E04D 13/076 210/162
2005/0257432 A1 11/2005 Higginbotham
2005/0279036 A1 12/2005 Brochu
2006/0037252 A1 2/2006 Gosse et al.
2006/0059825 A1* 3/2006 Wiercinski ..... C09J 7/38 52/506.01
2006/0090404 A1* 5/2006 Lovell ..... E04D 13/0481 52/97
2006/0117670 A1 6/2006 Tsioris
2006/0123710 A1* 6/2006 Lenney ..... E04D 13/076 52/12
2006/0179723 A1* 8/2006 Robins ..... E04D 13/076 52/11
2006/0196124 A1 9/2006 Bachman
2006/0213129 A1 9/2006 Bachman
2006/0230687 A1 10/2006 Ealer, Sr.
2006/0277831 A1* 12/2006 Bachman ..... E04D 13/0762 52/11
2006/0283096 A1* 12/2006 Bachman ..... E04D 13/076 52/11
2007/0054129 A1 3/2007 Kalkanoglu et al.
2007/0065640 A1 3/2007 Joedicke
2007/0094939 A1 5/2007 Bachman
2007/0107323 A1 5/2007 Higginbotham
2007/0199276 A1 8/2007 Duque
2007/0218251 A1 8/2007 Jacobs
2007/0220814 A1 9/2007 Faulks
2007/0234647 A1* 10/2007 Higginbotham .... E04D 13/0765 52/12
2007/0246449 A1 10/2007 Bachman
2008/0163561 A1* 7/2008 Lenney ..... E04D 13/076 52/12
2008/0187708 A1 8/2008 Decker
2008/0248241 A1 10/2008 Kalkanoglu et al.
2009/0056234 A1* 3/2009 Brochu ..... E04D 13/076 52/12
2009/0064628 A1 3/2009 Mellott et al.
2009/0300995 A1* 12/2009 Nikolopoulos ..... E04D 13/076 52/12
2010/0042579 A1 2/2010 Larsen et al.
2010/0287846 A1* 11/2010 Lenney ..... E04D 13/0762 52/12
2011/0056145 A1* 3/2011 Lenney ..... E04D 13/076 52/12
2011/0067318 A1* 3/2011 Lenney ..... E04D 13/076 52/12
2011/0138698 A1* 6/2011 Neumann ..... E04D 13/076 52/12
2011/0253611 A1 10/2011 Higginbotham
2012/0042579 A1 2/2012 McCoy
2013/0160377 A1 6/2013 Sager
2013/0160378 A1 6/2013 Higginbotham
2014/0013702 A1 1/2014 Pearce et al.
2014/0263001 A1 9/2014 Higginbotham

FOREIGN PATENT DOCUMENTS

JP 09228592 9/1997
JP 2000-008559 1/2000
KR 1989-10803 7/1989
KR 1989-23083 12/1989
KR 1998-16228 6/1998
WO WO1999053157 10/1999
WO WO-2012000051 A * 1/2012 ..... E04D 13/076

* cited by examiner

FIG. 1
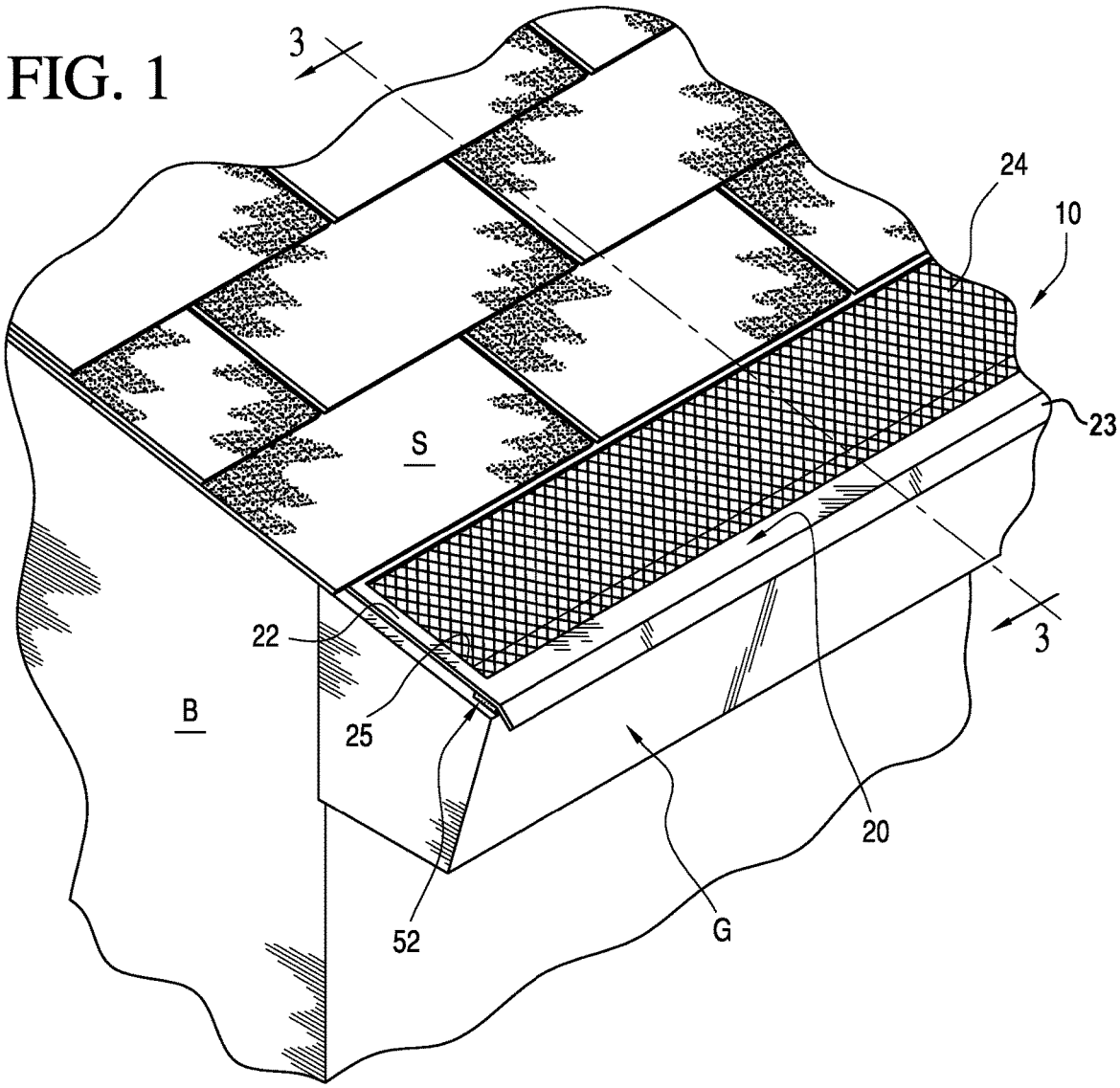
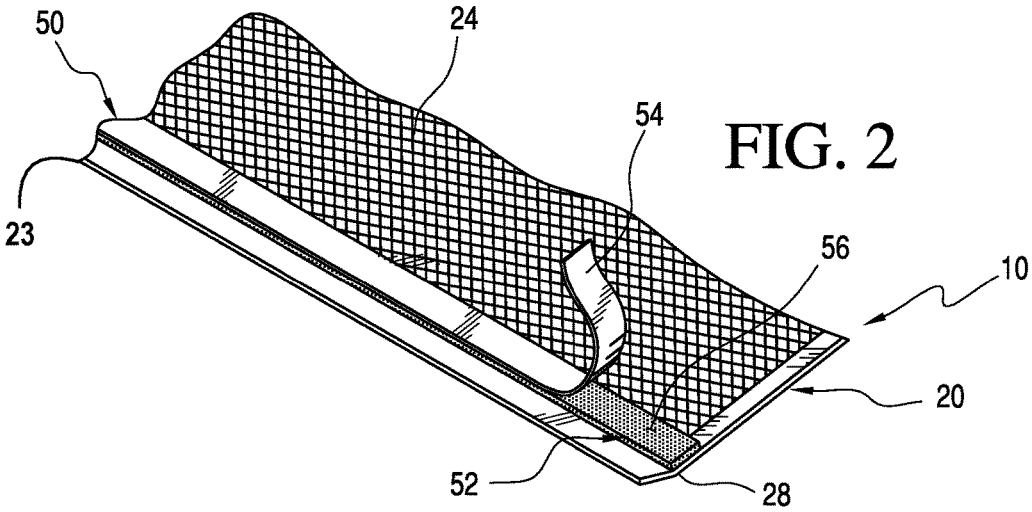
FIG. 2

FIG. 3
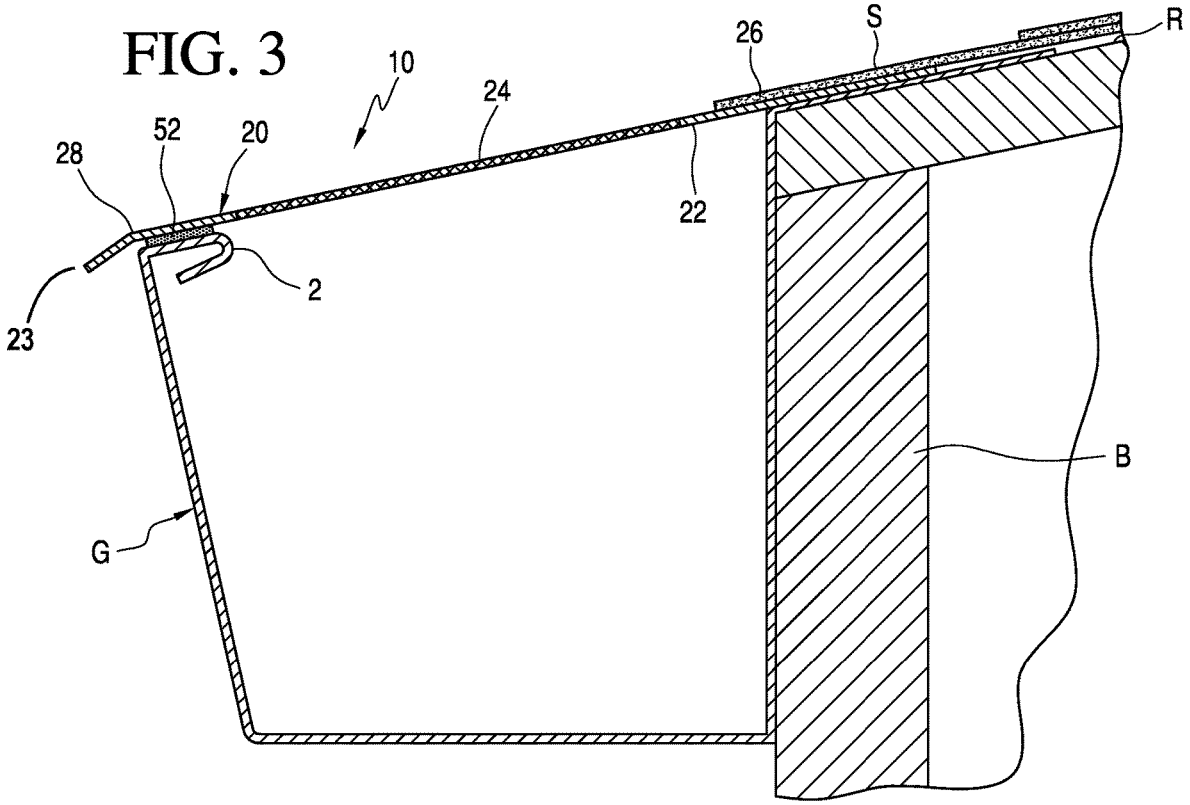
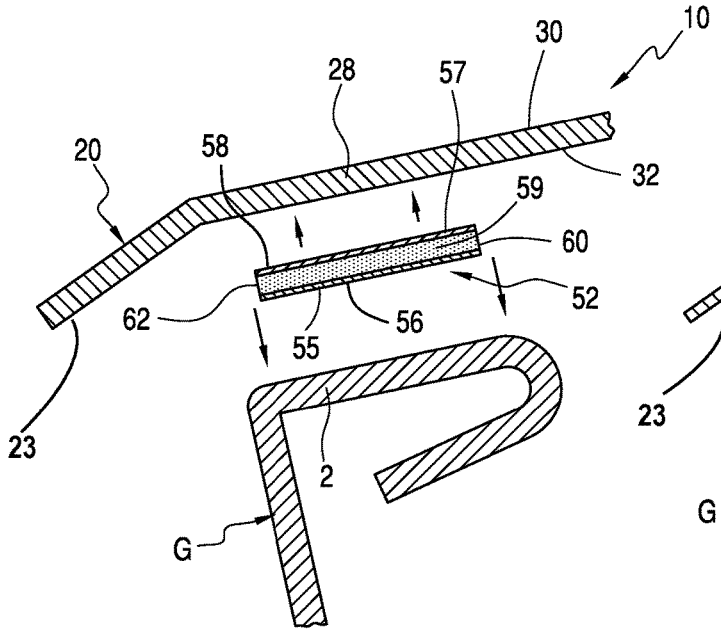
FIG. 4
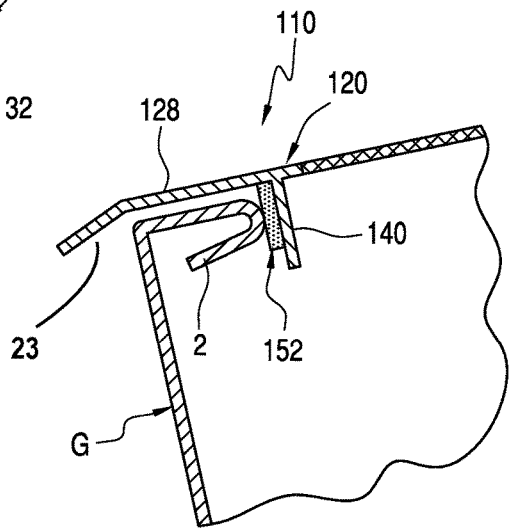
FIG. 5

GUTTER GUARD BARRIER

CROSS REFERENCE TO RELATED APPLICATION(S)

This application is a continuation application of U.S. patent application Ser. No. 15/665,944, filed Aug. 1, 2017, which is a divisional application of U.S. patent application Ser. No. 14/641,604, filed on Mar. 9, 2015 (now issued as U.S. Pat. No. 9,765,524), which is a continuation application of U.S. application Ser. No. 13/709,671, filed on Dec. 10, 2012 (now abandoned), which is a non-provisional application of U.S. Provisional Application No. 61/568,539 filed on Dec. 8, 2011, and this application claims priority to each of these applications, which are incorporated in their respective entireties herein by reference.

BACKGROUND OF THE INVENTION

1. Field of Invention

This invention relates to barriers for rain gutters and similar structures for keeping leaves and other debris out of the rain gutters. More particularly, this invention relates to rain gutter debris preclusion devices, which utilize a screen to allow water to pass into the gutter, but preclude debris from passing through the screen and into the gutter.

2. Description of Related Art

Prior gutter debris preclusion devices have been effective in preventing debris from passing through the screen and entering the gutter. Examples of such devices include and not limited to the devices disclosed in U.S. Pat. No. 7,310,912, (hereinafter the '912 patent) issued to Robert C. Lenney and John Lewis and U.S. Publication No. US 2011/0056145, (hereinafter the'145 publication) by Robert C. Lenney and John Lewis. The '912 patent and the '145 publication are both incorporated herein by reference in their respective entireties.

SUMMARY OF THE INVENTION

Despite the effectiveness of the devices taught by the '912 patent and the '145 publication, there are still areas for enhancement and modification to those devices. The present invention addresses some of these areas for modification. One such modification is in the area of fastening the gutter guard to the gutter. In some prior art, gutter guards are placed on the gutter without any sort of fasteners. These gutter guards would move around on the gutter, or fall off of the gutter, making them less likely to work appropriately. In other prior art, gutter guards are affixed with traditional screw fasteners. These screw fasteners would keep the gutter guard effectively on the gutter, however, they would cause a very labor intensive installation, and would increase corrosion, by placing the two metal products in direct contact with each other. This devices and methods of the present invention overcomes the drawbacks of the prior art by using non metal fasteners that keep the gutter guard in place, reduce corrosion by creating a buffer between the metal pieces, and reduce the labor requirement for installation by creating a quick and easy means of installation.

This invention overcomes the drawbacks and shortcomings of the prior art conventional devices. These and other features and advantages of this invention are described in, or are apparent from, the following detailed description of various exemplary embodiments of the devices and methods according to this invention.

This invention provides a gutter debris preclusion device that is more time efficient and cost effective to install on a gutter.

This invention further provides a gutter debris preclusion device that enhances the life span of the gutter and the debris preclusion device once the device has been installed on a gutter. The present invention provides corrosion resistance.

This invention further provide a rapid installation method of a gutter debris preclusion device to a gutter.

The invention provides a gutter debris preclusion device for use with a gutter, comprising: a support structure being substantially rigid; a screen having a plurality of apertures and being disposed on the support structure; and, a fastener member disposed on the support structure and having a barrier member and a protective film removably attached to the barrier member. The invention additionally provides that the barrier member is a corrosion barrier. Moreover the fastener member in some exemplary embodiments is double sided tape.

Still further the support structure in some embodiments includes a gutter lip and the fastener member is disposed on the gutter lip. The barrier member in some embodiments is a laminate. Further, in some exemplary embodiments the barrier member is a laminate having a first and second adhesive layers with a middle layer disposed between the first and second adhesive layers. Yet in other exemplary embodiments, the barrier is not a laminate. In some exemplary embodiments, the barrier member is made from a single unitary material.

The fastener member is operably configured to be affixed to the gutter when the device is in use and after the protective film has been removed from the barrier member.

The present invention additionally provides a gutter debris preclusion device for use with a gutter, comprising: a screen having a plurality of apertures and opposing first and second surfaces; a fastener member disposed on the first surface of the screen and having a barrier member and a protective film removably attached to the barrier member; and, a backing member disposed on the second surface of the screen aligned with the fastener. The backing member in some embodiments is adhesive tape. The barrier member in some embodiments is a laminate structure. The barrier member in some embodiments is a laminate having a first and second adhesive layers with a middle layer disposed between the first and second adhesive layers. In other exemplary embodiments, the backing member is a laminate having an adhesive layer and a top layer disposed adjacent to the adhesive. Still in other embodiments, the barrier member is double sided tape. Yet further, the barrier member is a corrosion barrier.

The present invention moreover provides a gutter debris preclusion device holder for use with a gutter debris preclusion device and a gutter, comprising: a clip having first and second legs joined together at a midsection portion, wherein the first and second legs have distal ends defining an opening, wherein the first and second legs and the midsection portion define a cavity, and wherein the first and second legs are spring biasedly opposed at the opening; and, a fastener member disposed on the clip and having an adhesive surface and a protective film removably attached to the adhesive surface, wherein the cavity is operably configured to receive and hold a portion of the debris preclusion device when the device is in use. Further in some exemplary embodiments, the midsection portion has a generally curved profile shape.

The present invention also provides a method for fastening a debris preclusion device on a gutter attached to a building, comprising: obtaining a conventional debris preclusion device; providing a double sided adhesive member having first and second opposing surfaces and protective layers removably disposed over each of the first and second surfaces; removing the protective layer from the first surface of the double sided adhesive member; affixing the first surface of the double sided adhesive member to the debris preclusion device; placing the rear of the debris preclusion device under a roof shingle; removing the protective layer from the second surface of the adhesive member; and, pressing the second surface of the double sided adhesive material to a portion of a gutter lip of the gutter. In other exemplary embodiments, the steps of removing the protective layer from the first surface of the double sided adhesive member and the pressing the second surface of the double sided adhesive material precede the steps of removing the protective layer from the first surface of the double sided adhesive member and affixing the first surface of the double sided adhesive member to the debris preclusion device.

These and other features and advantages of this invention are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures, wherein;

FIG. 1 is a top partial perspective view of a gutter debris preclusion device installed on a gutter of a house made in accordance with the present invention;

FIG. 2 is a bottom partial perspective view of the gutter debris preclusion device of FIG. 1;

FIG. 3 is a cross-sectional side view of the gutter debris preclusion device of FIG. 1, taken along line 3-3 in FIG. 1;

FIG. 4 is a partial cross-sectional view of the gutter debris preclusion device of FIG. 1, shown in a state prior to assembly of a fastener member to a main body;

FIG. 5 is a partial cross-sectional view of an alternative embodiment of a gutter debris preclusion device made in accordance with the present invention;

DETAILED DESCRIPTION OF THE PREFERRED EMBODIMENTS

Figure 6:
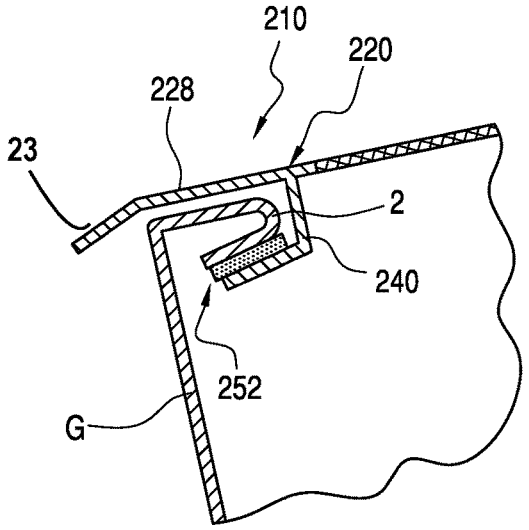
FIG. 6 is a partial cross-sectional view of another alternative embodiment of a gutter debris preclusion device made in accordance with the present invention.

Referring to the drawings, wherein like reference numerals represent like parts throughout the various drawing figures, FIGS. 1-4 display a debris preclusion device or gutter guard 10 made in accordance with the present invention. FIG. 1 displays a partial top perspective view of the gutter guard 10. The device 10 is shown in use on a gutter G attached to a building B.

FIG. 2 displays a partial bottom perspective view of the gutter guard 10. The gutter guard 10 includes a main body 20 and a fastener member 50.

As shown in FIGS. 3 and 4, a portion of the member 50 is operably configured to be disposed between a portion of the main body 20 and the gutter when the gutter guard is in use. More particularly when the gutter guard is in use, a portion of the member 50 is disposed between the main body 20 and a front lip 2 of the gutter G. FIG. 4 shows the gutter guard 10 in a state prior to the attachment of the member 50 to the main body 20 and prior to the gutter guard 10 being attached to the gutter G.

The main body 20 includes a support 22 and a screen 24. The support defines an opening 25. The screen is disposed within the opening 25 and is supported by the support 22. The support includes a tab portion 26 and a lip portion 28. It should be appreciated that the lip portion 28 directly above the gutter's front lip 2 is substantially parallel to the top surface of the gutter front lip 2, thus allowing for uniform adhesion between the two surfaces when attached with the barrier layer 52, as further described below. The tab portion 26 fastens the upper side of the main body 20 to the building. In this exemplary embodiment, the tab portion 26 is operably configured to be disposed between the roof R and shingles S when in use. The lip portion 28 is generally planar in its cross-sectional shape. However, as show in FIGS. 1-7, the terminal portion 23 (FIG. 4) can be configured to be "bent" downward at an acute angle and extend beyond the top of the gutter's front lip 2. It is evident this configuration provides a measure of protection from the elements at side 62 of barrier layer 52. Moreover, as shown in FIGS. 1-4, the barrier layer 52 is sized to cover the bulk of the gutter's front lip 2 and is attached to the main body 20 adjacent to the terminal portion 23. Having the majority of the front lip 2 covered with the barrier layer 52 physically separates the main body 20 from the gutter G, so as to prevent physical contact of the respective pieces. Of course, to provide an environmental seal along the exterior of the cover 20 to gutter lip 2 junction, the barrier layer 52 is placed along the entire length of the gutter G, for example as shown in FIGS. 1-2. The lip portion 28 includes a top surface 30 and a gutter surface 32. The lip portion 28 is operably configured to be disposed over the front gutter lip 2 when the device is in use on the gutter G.

Figure 8:
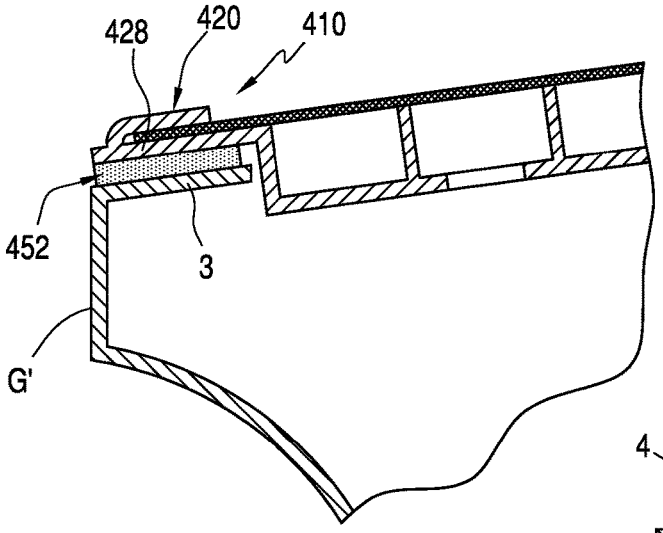
FIG. 8 is a partial cross-sectional view of another alternative embodiment of a gutter debris preclusion device made in accordance with the present invention.
Figure 9:
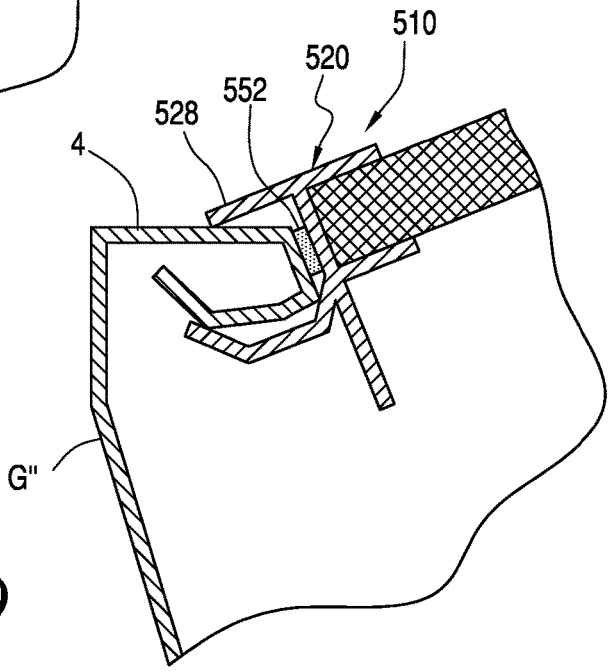
FIG. 9 is a partial cross-sectional view of another alternative embodiment of a gutter debris preclusion device made in accordance with the present invention.

It should be appreciated that the main body 20 can be any conventional debris preclusion devices that include a mesh support frame having a lip member that is operably configured to engage a gutter lip and not just the main body 20 shown in this exemplary embodiment. Other such devices include, but are not limited to devices taught by the '912 Patent and the '145 publication as shown in FIGS. 8 and 9.

The member 50 is a fastener operably configured to attach the main body 20 to the gutter G when the device is in use.

The member 50 includes a barrier member or layer 52 and a protective layer 54, as shown in FIG. 2. The protective layer 54 is removably attached to the layer 52. The barrier layer 52 includes a first surface 56 and an opposing second surface 58. The barrier layer 52 includes opposing first and second sides 60 and 62, both of which extend between the first and second surfaces 56 and 58. The second surface 58 is disposed adjacent to a portion of the main body 20. The second surface 58 is configured to be disposed on a portion of the gutter surface 32 of the lip portion 28. The first and second surfaces 56 and 58 are adhesive surfaces. The barrier layer 52 is preferably a laminate, with two opposing adhesive layers 55 and 57 and a middle layer 59 disposed between the two opposing adhesive layers 55 and 57 as shown in FIG. 4. The middle layer 59 is preferably made from plastic foam. The adhesive layers 55 and 57 are preferably made from a vinyl adhesive. The laminate layers are illustrated in FIG. 4 and not in the other figures for purposes of clarity. The first and second surfaces 56 and 58 are the exposed surfaces of the adhesive layers 55 and 57. In other exemplary embodiments, the barrier layer is only made from a vinyl material. Still further in other exemplary embodiments, the barrier layer is only made from a plastic foam material. It should be appreciated that the barrier layer may be made from a single unitary piece of material as well in other exemplary embodiments.

The member 50, in this exemplary embodiment, is a conventional double sided tape, such as, but not limited to, Automobile Acrylic Plus Attachment Tape, made by 3M, Inc., double sided auto trim tape made by Concord Industries, and polyethylene foam tape. It should be appreciated that other materials can be utilized for the member 50. The protective layer 54 is a backing layer that is selectively removable by a user prior to installation of the device 10. The protective layer 54 is operably configured to maintain the tackiness of the adhesive surface of the barrier member 52 prior to installation of the device 10.

In this exemplary embodiment, it should be appreciate that prior to the assembly of the member 50 to the main body 20, the member 50 includes a second protective layer 64 removably disposed on the second surface 58, as shown in FIG. 4. The second protective layer 64 is permanently removed to expose the adhesive second surface 58 to affix the barrier member 52 to the main body 20.

The barrier member 52 is also a corrosion barrier between the main body 20 and the gutter G. The main body 20 and the gutter are generally made from metal and the barrier member 52, when the device 10 is in use, is a corrosion barrier between the main body 20 and the gutter G helping to prevent galvanic corrosion by not allowing dissimilar metals to touch each other. This will improve the effective life of the gutter guard.

It should be appreciated that the fastener member can be pre-attached to a variety of gutter guard type devices, as shown in the exemplary embodiments in FIGS. 5-9 and the adhesive properties of the underside of the fastener member will fasten the gutter guard to the gutter.

It should be appreciated that in other exemplary embodiments additional fastener members are disposed between the top of the roof and the rear of the main body 20 that extends on to the roof when the device is in use. Still further in other exemplary embodiments another barrier member is disposed between a portion of the rear of the main body 20 that extends on to the roof when in use and under a portion of at least one shingle on the roof when the device is in use.

It will also be appreciated that the present invention includes a method of attaching a debris preclusion device to a gutter, as shown in the various figures, including FIG. 4. The method includes: obtaining a conventional debris preclusion device; providing a double sided adhesive member having first and second opposing surfaces and protective layers removably disposed over each of the first and second surfaces; removing the protective layer from the first surface of the double sided adhesive member; affixing the first surface of the double sided adhesive member to the debris preclusion device; placing the rear of the debris preclusion device 20 under a roof shingle; removing the protective layer from the second surface of the adhesive member; and, pressing the second surface of the double sided adhesive material to a portion of a gutter lip of the gutter. It should be appreciated that in various other exemplary embodiments, methods in accordance with this invention include applying the adhesive member first to the gutter and then pressing the gutter guard to the opposing surface of the adhesive member.

FIGS. 5-9 display alternative embodiments of debris preclusion devices made in accordance with the present invention. Particularly, in these alternative embodiments, various examples are shown wherein the fastener member is utilized with various gutter guard designs to form the gutter debris preclusion devices of the present invention.

FIG. 5 displays a portion of a debris preclusion device 110, which is an alternative exemplary embodiment of a gutter guard made in accordance with the present invention. The device 110 is identical to the device 10 described above except as noted and shown. The device 110 includes a main body 120 and a fastener member with a barrier member 152 and a removable protective layer. The protective layer of this fastener member is not shown in FIG. 5 for purposes of clarity and since the device 110 is shown in a state of being installed on a gutter wherein the protective layer has been removed. The main member 120 includes a lip portion 128, which is operably configured to be disposed over the lip 2 of the gutter G when the device is in use. A difference between this device 110 and the device 10 is that the lip portion 128 of the device 110 includes a gutter drip leg 140. The gutter drip leg 140 extends from the lip portion 128 into a channel of the gutter and is operably configured to be opposing a portion of the gutter lip 2 when the device is in use. The barrier member 152 is attached to the gutter drip leg 140.

FIG. 6 displays a portion of a debris preclusion device 210, which is an alternative exemplary embodiment of a gutter guard made in accordance with the present invention. The device 210 is identical to the device 110 described above except as noted and shown. The device 210 includes a main body 220 and a fastener member having a barrier member 252 and a removable protective layer. The protective layer of this fastener member is not shown in FIG. 6 for purposes of clarity and since the device 210 is shown in a state of being installed on a gutter wherein the protective layer has been removed. The main member 220 includes a lip portion 228, which is operably configured to be disposed over the lip 2 of the gutter G when the device is in use. The lip portion 228 of the device 210 includes a gutter drip leg 240. A difference between this device 210 and the device 110 is that the gutter drip leg 240 extends from the lip portion 228 into a channel of the gutter and beneath a portion of the gutter lip 2 when the device is in use. The barrier member 252 is attached to the gutter drip leg 240.

Figure 7:
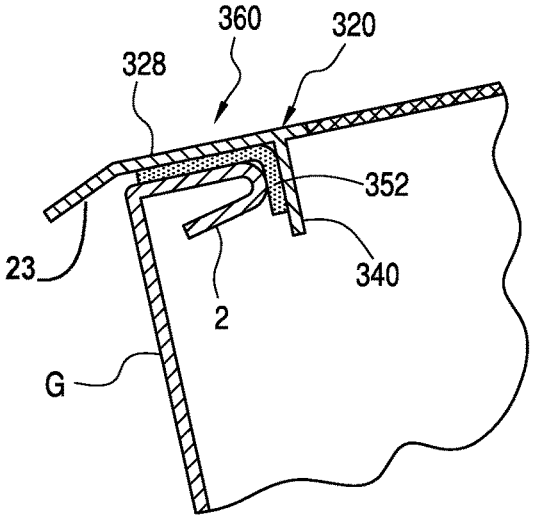
FIG. 7 is a partial cross-sectional view of another alternative embodiment of a gutter debris preclusion device made in accordance with the present invention.

FIG. 7 displays a portion of a debris preclusion device 310, which is an alternative exemplary embodiment of a gutter guard made in accordance with the present invention. The device 310 is identical to the device 110 described above except as noted and shown. The device 310 includes a main body 320 and a fastener member having a barrier member 352 and a removable protective layer. The protective layer of this fastener member is not shown in FIG. 7 for purposes of clarity and since the device 310 is shown in a state of being installed on a gutter wherein the protective layer has been removed. The main member 320 includes a lip portion 328, which is operably configured to be disposed over the lip 2 of the gutter G when the device is in use. The lip portion 328 of the device 310 includes a gutter drip leg 340. The gutter drip leg 340 extends from the lip portion 328 into a channel of the gutter and is operably configured to be opposing a portion of the gutter lip 2 when the device is in use. The member 350 is attached to the gutter drip leg 340. A difference between this device 310 and the device 110 is that the barrier member 352 is attached to both, the bottom of the lip portion 328 and the drip leg 340. In this exemplary embodiment, the barrier member 352 is a unitary member that bends and extends between the lip portion 328 and the drip leg 340. However, it should be appreciated that in other exemplary embodiments, the barrier member 352 includes two or more pieces with at least one on the lip portion 328 and at least one on the drip leg 340.

FIG. 8 displays a portion of a debris preclusion device 410, which is an alternative exemplary embodiment of a gutter guard made in accordance with the present invention. The device 410 is identical to the device 10 described above except as noted and shown. The device 410 includes a main body 420 and a fastener member having a barrier member 452 and a removable protective layer. The protective layer of this fastener member is not shown in FIG. 8 for purposes of clarity and since the device 410 is shown in a state of being installed on a gutter wherein the protective layer has been removed. The main member 420 includes a lip portion 428, which is operably configured to be disposed over a lip 3 of a gutter G' when the device is in use. A difference between this device 410 and the device 10 is that the main body 420 is a debris preclusion device as taught and disclosed in the '912 patent.

FIG. 9 displays a portion of a debris preclusion device 510, which is an alternative exemplary embodiment of a gutter guard made in accordance with the present invention. The device 510 is identical to the device 10 described above except as noted and shown. The device 510 includes a main body 520 and a fastener member having a barrier member 552 and a removable protective layer. The protective layer of this fastener member is not shown in FIG. 9 for purposes of clarity and since the device 510 is shown in a state of being installed on a gutter wherein the protective layer has been removed. The main member 520 includes a lip portion 528, which is operably configured to be disposed over a lip 4 of a gutter G" when the device is in use. A difference between this device 510 and the device 10 is that the main body 520 is a debris preclusion device as taught and disclosed in the '145 publication.

Figure 10:
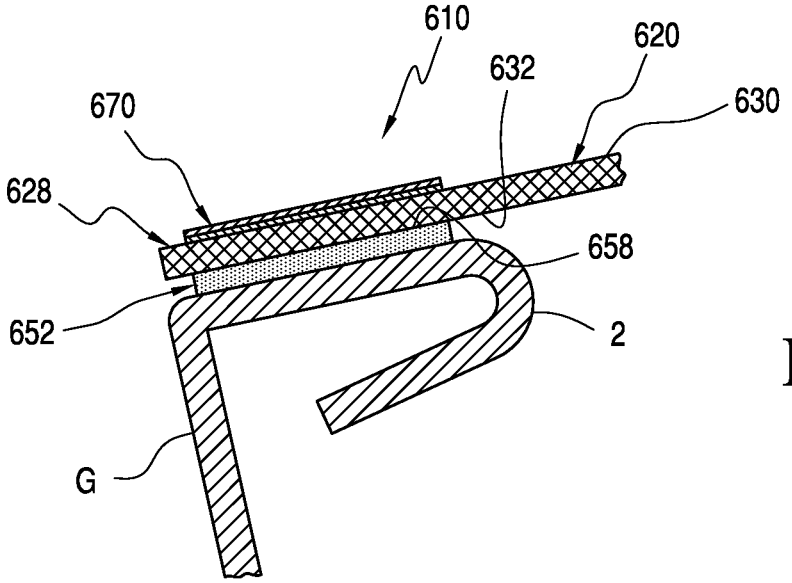
FIG. 10 is a partial cross-sectional view of another alternative embodiment of a gutter debris preclusion device made in accordance with the present invention.

FIG. 10 displays a portion of a debris preclusion device 610, which is an alternative exemplary embodiment of a gutter guard made in accordance with the present invention. The device 610 is identical to the device 10 described above except as noted and shown. The device 620 includes a main body 620 and a fastener member having a barrier member 652 and a removable protective layer. The protective layer of this fastener member is not shown in FIG. 10 for purposes of clarity and since the device 610 is shown in a state of being installed on a gutter wherein the protective layer has been removed. The main member 620 includes a lip portion 628, which is operably configured to be disposed over a lip 2 of the gutter G when the device is in use. A difference between this device 610 and the device 10 is that the main body 620 is a screen mesh, wherein the lip portion 628 is formed as part of the screen mesh as opposed to a support member having a solid planar surface to which the barrier member 652 can adhere. Since in this embodiment, the main body 620 is a screen mesh, it includes voids or holes inherent to a screen mesh. The barrier member 652 includes an adhesive surface 658. To enhance the adhesion of the adhesive surface 658 to the underside surface 632 of the lip portion 628, the device 610 includes a backing member 670. The backing member 670 is a shape that is similar to the shape of the member 650. It is preferred that the backing member 670 be at least the same width and length as the barrier member 652. The backing member 670 is disposed on a top surface 630 of the lip portion 628. The backing member is disposed on the top surface 630 substantially aligned with barrier member 652, which disposed on the opposing underside surface 632 of the lip portion 628. With the backing member 670, the adhesion surface 658 extends through (not shown for clarity) the holes of the lip portion 628 to adhere not only to the lip portion 628 but also to the backing member 670. The backing member 670 is preferably a single sided adhesive tape. It should be appreciated that the backing member 670 in other exemplary embodiments is a plastic bar, metal bar, or is made from other materials. The backing member 670 does not need to be a solid member.

Figure 11:
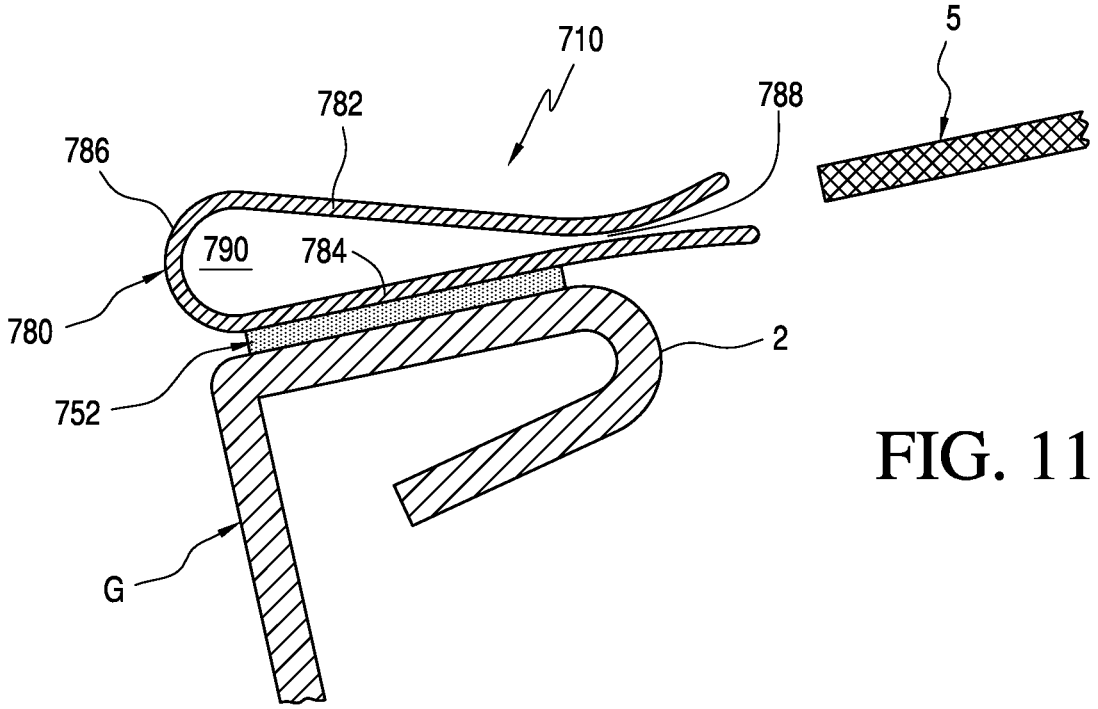
FIG. 11 is a partial cross-sectional view of a gutter debris preclusion device holder made in accordance with the present invention shown in use with a gutter and a gutter debris preclusion device.
Figure 12:
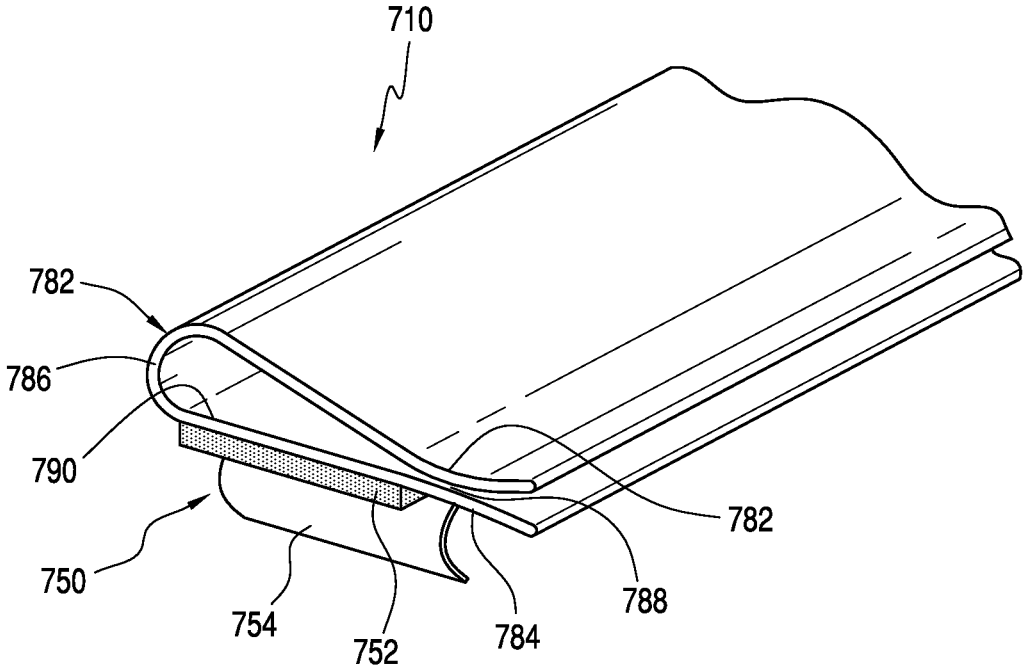
FIG. 12 is a partial top perspective view of the gutter debris preclusion device holder of FIG. 11; and, FIG. 13 is a partial cross-sectional view of another alternative embodiment of a gutter debris preclusion device holder made in accordance with the present invention shown in use with a gutter and a gutter debris preclusion device.

FIGS. 11 and 12 display a debris preclusion device holder 710 made in accordance with the present invention. The device 710 includes a clip member 780 and a fastener member 750 having a barrier member 752 and a removable protective layer 754. The protective layer of this fastener member is not shown in FIG. 11 for purposes of clarity and since the device 710 is shown in a state of being installed on a gutter wherein the protective film has been removed. FIG. 11 illustrates the holder 710 in use on a gutter G having a gutter lip 2. The member 750 is identical to the member 50 described above for device 10 and it includes a removable protective layer (film) 754, which is removed when the holder 710 is in use, as shown in FIG. 11.

The clip member 780 includes opposing first and second legs 782 and 784 and a midsection portion 786. The first and second legs 782 and 784 are joined together at one end by the midsection portion 786. The first and second legs 782 and 784 have opposing other distal ends that define an opening 788. The first and second legs 782 and 784 and the midsection portion 786 define a cavity 790. The midsection portion 785 has a generally curved profile to create a spring bias between the first and second legs 782 and 784 at the opening 788.

The member 750 is operably configured to be attached to a portion of the lip 2 of the gutter G. The member 750 is operably configured to be attachable to any shaped gutter and gutter lip.

In operation, the cavity 790 is operably configure to receive a portion of a gutter debris preclusion device 5. A portion of the gutter debris preclusion device 5 will be inserted through the opening 788 and into the cavity 790. With the first and second legs 782 and 784 being spring biased, the clip 780 will apply pressure to the portion of the gutter debris preclusion device 5 at the opening 788 when it is inserted into the clip 780.

Figure 13:
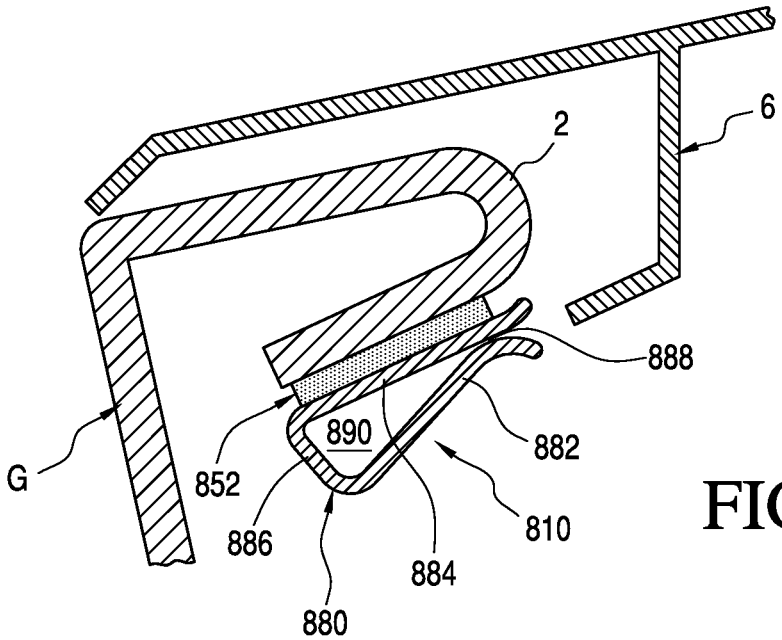

FIG. 13 displays a debris preclusion device holder 810, which is an alternative exemplary embodiment of a debris preclusion device holder in accordance with the present invention. The holder 810 is identical to the holder 710 described above except as noted and shown. The holder includes a fastener member having a barrier member 852 and a removable protective layer. The protective layer of this fastener member is not shown in FIG. 13 for purposes of clarity and since the device 810 is shown in a state of being installed on a gutter wherein the protective layer has been removed. The holder 810 includes first and second legs 882 and 884 and a midsection 886. The first and second legs 882 and 884 are joined together at one end by the midsection portion 886. The first and second legs 882 and 884 have opposing other ends that define an opening 888. The first and second legs 882 and 884 and the midsection portion 886 define a cavity 890. A difference between this holder 810 and the holder 710 is that the midsection portion 885 has a generally linear profile with rounded ends to join the first and legs 882 and 884, to create a spring bias between the first and second legs 882 and 884 at the opening 888. The device 810 is shown in use in FIG. 13 on the gutter lip 2 of the gutter G. In this embodiment, the device 810 is shown disposed, when in use, on a completely different portion of the gutter lip 2 than where the device 710 is disposed on the gutter lip. This illustrates and it should be appreciated how various exemplary embodiments of debris preclusion device holders made in accordance with the present invention can be disposed at various locations on the gutter to accommodate various gutter debris preclusion devices.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes and combinations thereof may be made without departing from the spirit and scope of this invention. It should be apparent that various different modifications can be made to the exemplary embodiments described herein without departing from the scope and spirit of this invention disclosure. When structures are identified as a means to perform a function, the identification is intended to include all structures, which can perform the function specified.

What is claimed is:

1. A gutter debris preclusion system for attachment to a gutter and roof, comprising:

a substantially planar gutter debris preclusion device wider than a width of a prospective gutter, having a main body with an integral roof side portion and integral gutter side terminal portion, the roof side portion being solid and running along a longitudinal length of the device and extending beyond a roof side edge of the prospective gutter and being configured for attachment to a prospective roof, the terminal portion running along the longitudinal length of the device and proximal to a lip of the prospective gutter and configured for attachment to a prospective gutter lip, comprising:

a screen having a plurality of apertures, the screen joined to the roof side portion and the terminal portion and spanning a face of the prospective gutter and;

a solid, non-porous contact portion disposed at an end of the terminal portion, whose bottom surface is substantially flat, the contact portion being coplanar to the screen;

a non-coplanar overhang portion extending from the contact portion and externally past the gutter lip of the prospective gutter, angled downward from a plane of the contact portion; and a drip leg joined to the contact portion, the drip leg extending downward into the prospective gutter; and a double-sided adhesive tape pre-attached to an entire length of at least one of the bottom surface of the contact portion and a surface of the drip leg, wherein the adhesive tape secures the at least one contact portion and drip leg to the prospective gutter lip and forms a seal therebetween, and prevents galvanic corrosion between the gutter debris preclusion device and the prospective gutter.

2. The gutter debris preclusion system as recited in claim 1, wherein the adhesive tape is a laminate having a first and second adhesive layers with a middle layer disposed between the first and second adhesive layers.

3. The gutter debris preclusion system as recited in claim 1, wherein the drip leg includes a terminal element angled to be disposed under the prospective gutter lip.

4. A gutter debris preclusion system for attachment to a gutter lip and roof, comprising:

a substantially planar gutter debris preclusion device with a-main body, having an integral roof side portion and integral gutter side terminal portion, the device being wider than a width of a prospective gutter, the roof side being configured for attachment to a prospective roof, and the terminal portion running along a length of the device and proximal to a lip of the prospective gutter, comprising:

a screen having a plurality of apertures, the screen joined to the roof side portion and the terminal portion and spanning a face of the prospective gutter;

a solid, non-porous contact portion disposed at an end of the terminal portion, whose bottom surface is substantially flat, the contact portion being coplanar to the screen;

a non-coplanar overhang portion extending externally past the gutter lip of the prospective gutter from the contact portion, angled downward from a plane of the contact portion; and a drip leg joined to a bottom of the contact portion, the drip leg extending downward into the prospective gutter, wherein the drip leg is proximal to a lip of the prospective gutter; and, adhesive means pre-attached along an entire length of at least one of the bottom surface of the contact portion and a surface of the drip leg, and upon attachment to the prospective gutter lip, secures the device to the gutter lip, and forms a seal between the contact portion and the prospective gutter lip and prevents galvanic corrosion between the gutter preclusion device and the prospective gutter.

5. The gutter debris preclusion system, as recited in claim 4, wherein the adhesive means is configured with a removable protective film that is removed prior to attachment to the prospective gutter lip.

* * * * *